US006718302B1

(12) United States Patent
Wu et al.

(10) Patent No.: US 6,718,302 B1
(45) Date of Patent: Apr. 6, 2004

(54) METHOD FOR UTILIZING VALIDITY CONSTRAINTS IN A SPEECH ENDPOINT DETECTOR

(75) Inventors: Duanpei Wu, San Jose, CA (US); Miyuki Tanaka, Tokyo (JP); Ruxin Chen, San Jose, CA (US); Lex Olorenshaw, Corte Madera, CA (US)

(73) Assignees: Sony Corporation, Tokyo (JP); Sony Electronics Inc., Park Ridge, NJ (US)

( * ) Notice: Subject to any disclaimer, the term of this patent is extended or adjusted under 35 U.S.C. 154(b) by 0 days.

(21) Appl. No.: 09/482,396

(22) Filed: Jan. 12, 2000

Related U.S. Application Data

(63) Continuation-in-part of application No. 09/176,178, filed on Oct. 21, 1998, now Pat. No. 6,230,122, and a continuation-in-part of application No. 08/957,875, filed on Oct. 20, 1997, now Pat. No. 6,216,103.

(60) Provisional application No. 60/160,809, filed on Oct. 21, 1999.

(51) Int. Cl.[7] ..... G10L 11/02

(52) U.S. Cl. ..... 704/233; 704/226; 704/253; 381/94.3

(58) Field of Search ..... 704/233, 248, 704/253, 226; 381/94.3

(56) References Cited

U.S. PATENT DOCUMENTS

| | | | | |
|---|---|---|---|---|
| 4,281,218 A | * | 7/1981 | Chuang et al. | 370/435 |
| RE32,172 E | | 6/1986 | Johnston et al. | 704/253 |
| 4,628,529 A | | 12/1986 | Borth et al. | 381/94.3 |
| 4,821,325 A | | 4/1989 | Martin et al. | 704/253 |
| 5,617,508 A | | 4/1997 | Reaves | 704/233 |
| 5,848,388 A | * | 12/1998 | Power et al. | 704/239 |
| 5,884,255 A | | 3/1999 | Cox | 704/233 |
| 5,991,277 A | * | 11/1999 | Maeng et al. | 370/263 |
| 6,006,175 A | * | 12/1999 | Holzrichter | 704/208 |
| 6,044,342 A | | 3/2000 | Sato et al. | 704/233 |

OTHER PUBLICATIONS

Lawrence E. Rabiner and Ronald W. Schafer, Digital Processing of Speech Signals, Prentice Hall, Upper Saddle River, NJ, 1978, pp. 158–161.*

* cited by examiner

*Primary Examiner*—Richemond Dorvil
*Assistant Examiner*—Donald L. Storm
(74) *Attorney, Agent, or Firm*—Gregory J. Koerner; Simon & Koerner LLP

(57) ABSTRACT

A method for utilizing validity constraints in a speech endpoint detector comprises a validity manager that may utilize a pulse width module to validate utterances that include a plurality of energy pulses during a certain time period. The validity manager also may utilize a minimum power module to ensure that speech energy below a predetermined level is not classified as a valid utterance. In addition the validity manager may use a duration module to ensure that valid utterances fall within a specified duration. Finally, the validity manager may utilize a short-utterance minimum power module to specifically distinguish an utterance of short duration from background noise based on the energy level of the short utterance.

8 Claims, 14 Drawing Sheets

METHOD FOR UTILIZING VALIDITY CONSTRAINTS IN A SPEECH ENDPOINT DETECTOR

CROSS-REFERENCE TO RELATED APPLICATIONS

This application is related to, and claims priority in, co-pending U.S. Provisional Patent Application Serial No. 60/160,809, entitled "Method For Utilizing Validity Constraints In A Speech Endpoint Detector," filed on Oct. 21, 1999. This application is a continuation-in-part to, and claims priority in, U.S. patent application Ser. No. 08/957,875, entitled "Method For Implementing A Speech Recognition System For Use During Conditions With Background Noise," filed on Oct. 20, 1997, now U.S. Pat. 6,216,103, and a continuation-in-part to U.S. patent application Ser. No. 09/176,178, entitled "Method For Suppressing Background Noise In A Speech Detection System," filed on Oct. 21, 1998, now U.S. Pat. 6,230,122 entitled "Speech Detection With Noise Suppression Based On Principal Components Analysis. All of the foregoing related applications are commonly assigned, and are hereby incorporated by reference.

BACKGROUND OF THE INVENTION

1. Field of the Invention

This invention relates generally to electronic speech recognition systems, and relates more particularly to a method for utilizing validity constraints in a speech endpoint detector.

2. Description of the Background Art

Implementing an effective and efficient method for system users to interface with electronic devices is a significant consideration of system designers and manufacturers. Human speech recognition is one promising technique that allows a system user to effectively communicate with selected electronic devices, such as digital computer systems. Speech typically consists of one or more spoken utterances which each may include a single word or a series of closely-spaced words forming a phrase or a sentence. In practice, speech recognition systems typically determine the endpoints (the beginning and ending points) of a spoken utterance to accurately identify the specific sound data intended for analysis. Conditions with significant ambient background-noise levels present additional difficulties when implementing a speech recognition system. Examples of such conditions may include speech recognition in automobiles or in certain manufacturing facilities. In such user applications, in order to accurately analyze a particular utterance, a speech recognition system may be required to selectively differentiate between a spoken utterance and the ambient background noise.

Referring now to FIG. 1, a diagram of speech energy 110 from an exemplary spoken utterance is shown. In FIG. 1, speech energy 110 is shown with time values displayed on the horizontal axis and with speech energy values displayed on the vertical axis. Speech energy 110 is shown as a data sample which begins at time 116 and which ends at time 118. Furthermore, the particular spoken utterance represented in FIG. 1 includes a beginning point $t_s$ which is shown at time 112 and also includes an ending point $t_e$ which is shown at time 114.

In many speech detection systems, the system user must identify a spoken utterance by manually indicating the beginning and ending points with a user input device, such as a push button or a momentary switch. This "push-to-talk" system presents serious disadvantages in applications where the system user is otherwise occupied, such as while operating an automobile in congested traffic conditions. A system that automatically identifies the beginning and ending points of a spoken utterance thus provides a more effective and efficient method of implementing speech recognition in many user applications.

Speech recognition systems may use many different techniques to determine endpoints of speech. However, in spite of attempts to select techniques that effectively and accurately allow the detection of human speech, robust speech detection under conditions of significant background noise remains a challenging problem. A system that utilizes effective techniques to perform robust speech detection in conditions with background noise may thus provide more useful and powerful method of speech recognition. Therefore, for all the foregoing reasons, implementing an effective and efficient method for system users to interface with electronic devices remains a significant consideration of system designers and manufacturers.

SUMMARY OF THE INVENTION

In accordance with the present invention, a method for utilizing validity constraints in a speech endpoint detector is disclosed. In one embodiment, a validity manager preferably includes, but is not limited to, a pulse width module, a minimum power module, a duration module, and a short-utterance minimum power module.

In accordance with the present embodiment, the pulse width module may advantageously utilize several constraint variables during the process of identifying a valid reliable island for a particular utterance. The pulse width module preferably measures individual pulse widths in speech energy, and may then store each pulse width in constraint value registers as a single pulse width (SPW) value. The pulse width module may then reference the SPW values to eliminate any energy pulses that are less than a pre-determined duration.

The pulse width module may also measure gap durations between individual pulses in speech energy (corresponding to the foregoing SPW values), and may then store each gap duration in constraint value registers as a pulse gap (PG) value. The pulse width module may then reference the PG values to control the maximum allowed gap duration between the energy pulses to be included a TPW value constraint that is discussed below.

In the present embodiment, the validity manager may advantageously utilize the pulse width module to detect a valid reliable island during conditions where speech energy includes multiple speech energy pulses within a certain pre-determined time period "P". In certain embodiments, a beginning point for a reliable island is detected when sequential values for the detection parameter DTF are greater than a reliable island threshold $T_{sr}$ for a given number of consecutive frames. However, for multi-syllable words, a single syllable may not last long enough to satisfy the condition of P consecutive frames.

The pulse width module may therefore preferably sum each energy pulse identified with a SPW value (subject to the foregoing PG value constraint) to thereby produce a total pulse width (TPW) value, that may also be stored in constraint value registers. The validity manager may thus detect a reliable island whenever a TPW value is greater than a reliable island threshold $T_{sr}$ for a given number of consecutive frames "P".

In addition, the validity manager may preferably utilize the minimum power module to ensure that speech energy below a pre-determined level is not classified as a valid utterance, even when the pulse width module identifies a valid reliable island. Therefore, in the present embodiment, the minimum power module preferably compares the magnitude peak of segments of the speech energy to a pre-determined constant value, and rejects utterances with a magnitude peak speech energy below the constant value as invalid.

In the present embodiment, the validity manager also preferably utilizes the duration module to impose duration constraints on a given detected segment of speech energy. Therefore, the duration module may preferably compare the duration of a detected segment of speech energy to two pre-determined constant duration values. In accordance with the present invention, segments of speech with durations that are greater than a first constant are preferably classified as noise. Segments of speech with durations that are less than a second constant are preferably analyzed further by the short-utterance minimum power module as discussed below.

In the present embodiment, the validity manager may preferably utilize the short-utterance minimum power module to distinguish an utterance of short duration from background pulse noise. To distinguish a short utterance from background noise, the short utterance preferably has a relatively high energy value.

Therefore, the short-utterance minimum power module may preferably compare the magnitude peak of segments of the speech energy to a pre-determined constant value that is relatively larger than the pre-determined constant utilized by the foregoing minimum power module. The present invention thus efficiently and effectively implements a method for utilizing validity constraints in a speech endpoint detector.

BRIEF DESCRIPTION OF THE DRAWINGS

FIG. 9(*b*) is a diagram of exemplary speech energy illustrating the calculation of thresholds, in accordance with one embodiment of the present invention;

DETAILED DESCRIPTION OF THE PREFERRED EMBODIMENT

The present invention relates to an improvement in speech recognition systems. The following description is presented to enable one of ordinary skill in the art to make and use the invention and is provided in the context of a patent application and its requirements. Various modifications to the preferred embodiment will be readily apparent to those skilled in the art and the generic principles herein may be applied to other embodiments. Thus, the present invention is not intended to be limited to the embodiment shown, but is to be accorded the widest scope consistent with the principles and features described herein.

The present invention comprises a method for utilizing validity constraints in a speech endpoint detector, and includes a validity manager that may utilize a pulse width module to validate utterances that include a plurality of energy pulses during a certain time period. The validity manager also may utilize a minimum power module to ensure that speech energy below a pre-determined level is not classified as a valid utterance. In addition the validity manager may use a duration module to ensure that valid utterances fall within a specified duration. Finally, the validity manager may utilize a short-utterance minimum power module to specifically distinguish an utterance of short duration from background noise based on the energy level of the short utterance.

Figure 1:
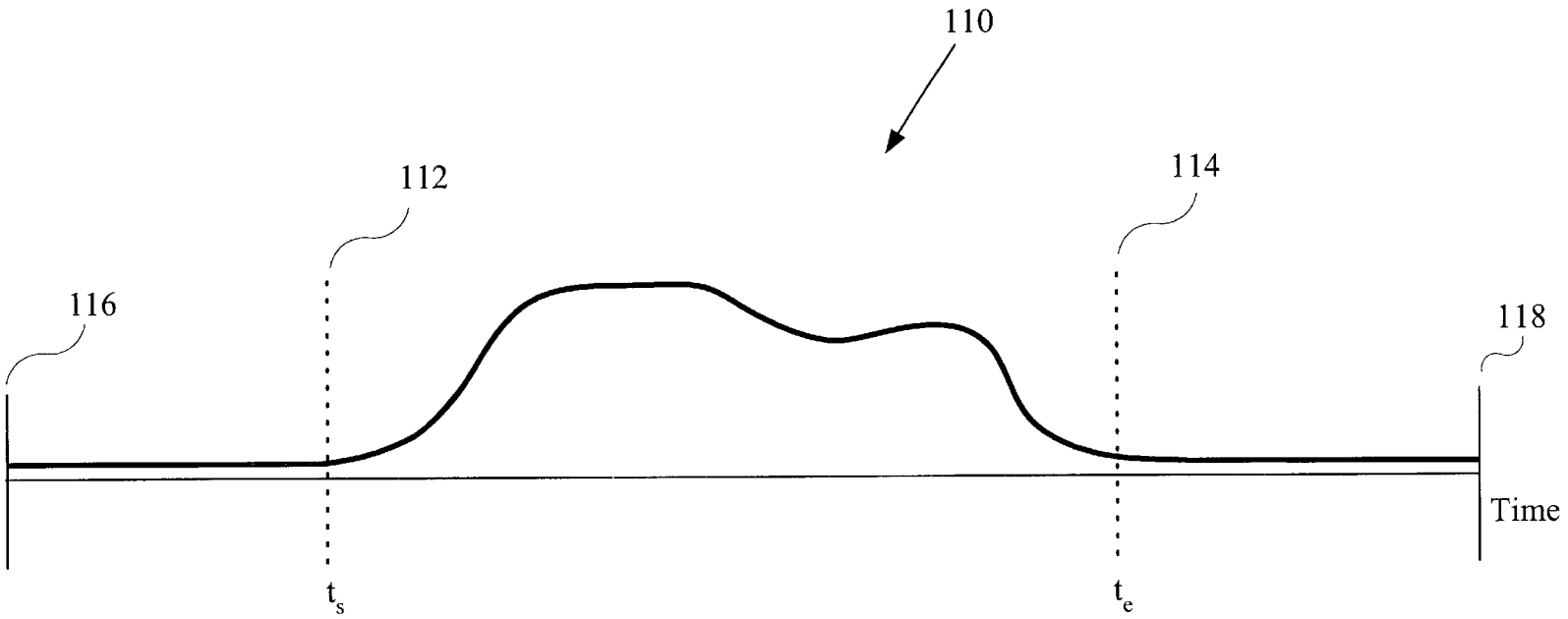
FIG. 1 is a diagram of speech energy from an exemplary spoken utterance.
Figure 2:
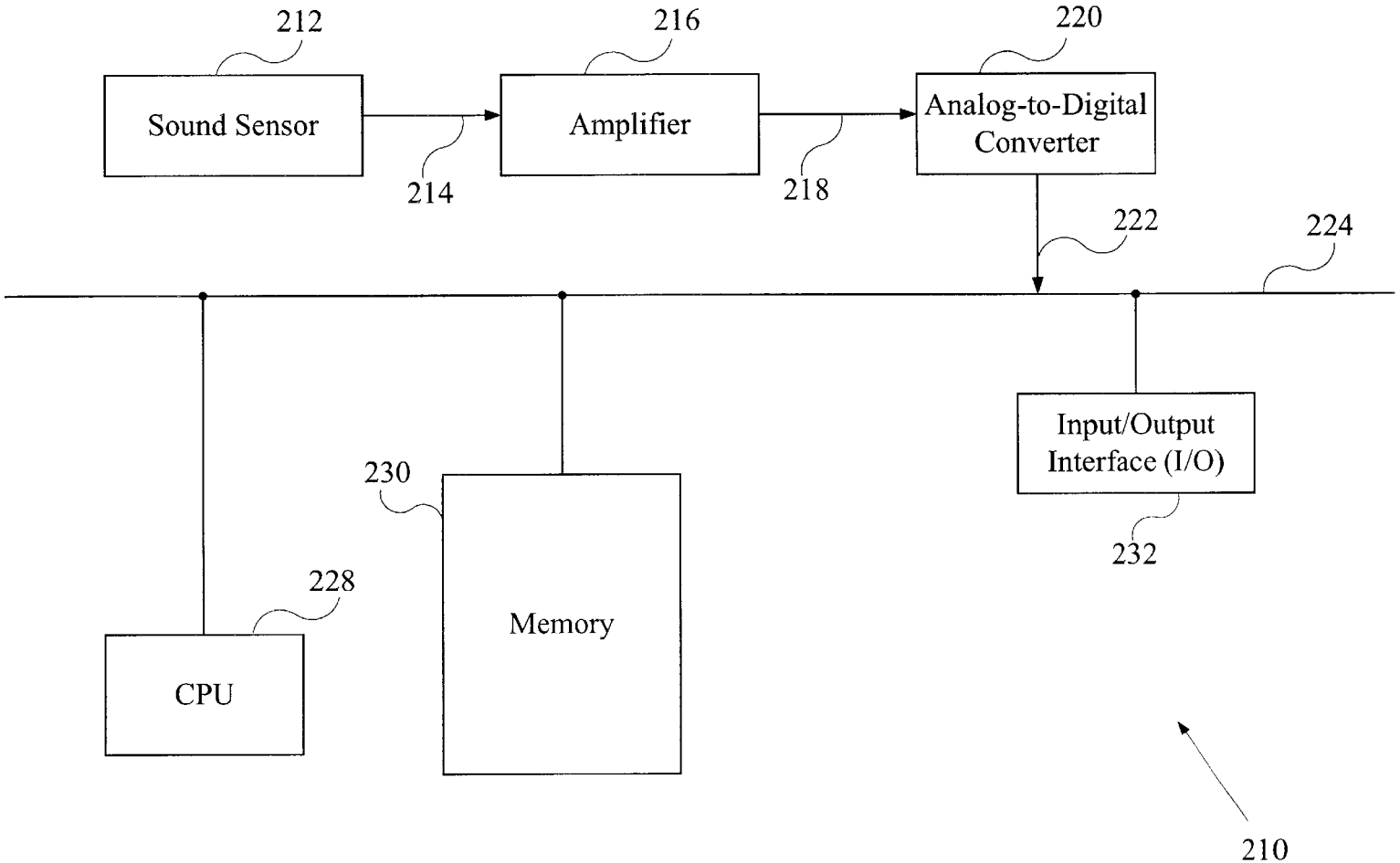
FIG. 2 is a block diagram of one embodiment for a computer system, in accordance with the present invention.

Referring now to FIG. 2, a block diagram of one embodiment for a computer system 210 is shown, in accordance with the present invention. The FIG. 2 embodiment includes a sound sensor 212, an amplifier 216, an analog-to-digital converter 220, a central processing unit (CPU) 228, a memory 230 and an input/output device 232.

In operation, sound sensor 212 detects ambient sound energy and converts the detected sound energy into an analog speech signal which is provided to amplifier 216 via line 214. Amplifier 216 amplifies the received analog speech signal and provides an amplified analog speech signal to analog-to-digital converter 220 via line 218. Analog-to-digital converter 220 then converts the amplified analog speech signal into corresponding digital speech data and provides the digital speech data via line 222 to system bus 224.

CPU 228 may then access the digital speech data on system bus 224 and responsively analyze and process the digital speech data to perform speech recognition according to software instructions contained in memory 230. The operation of CPU 228 and the software instructions in memory 230 are further discussed below in conjunction with FIGS. 3–13. After the speech data is processed, CPU 228 may then advantageously provide the results of the speech recognition analysis to other devices (not shown) via input/output interface 232.

Figure 3:
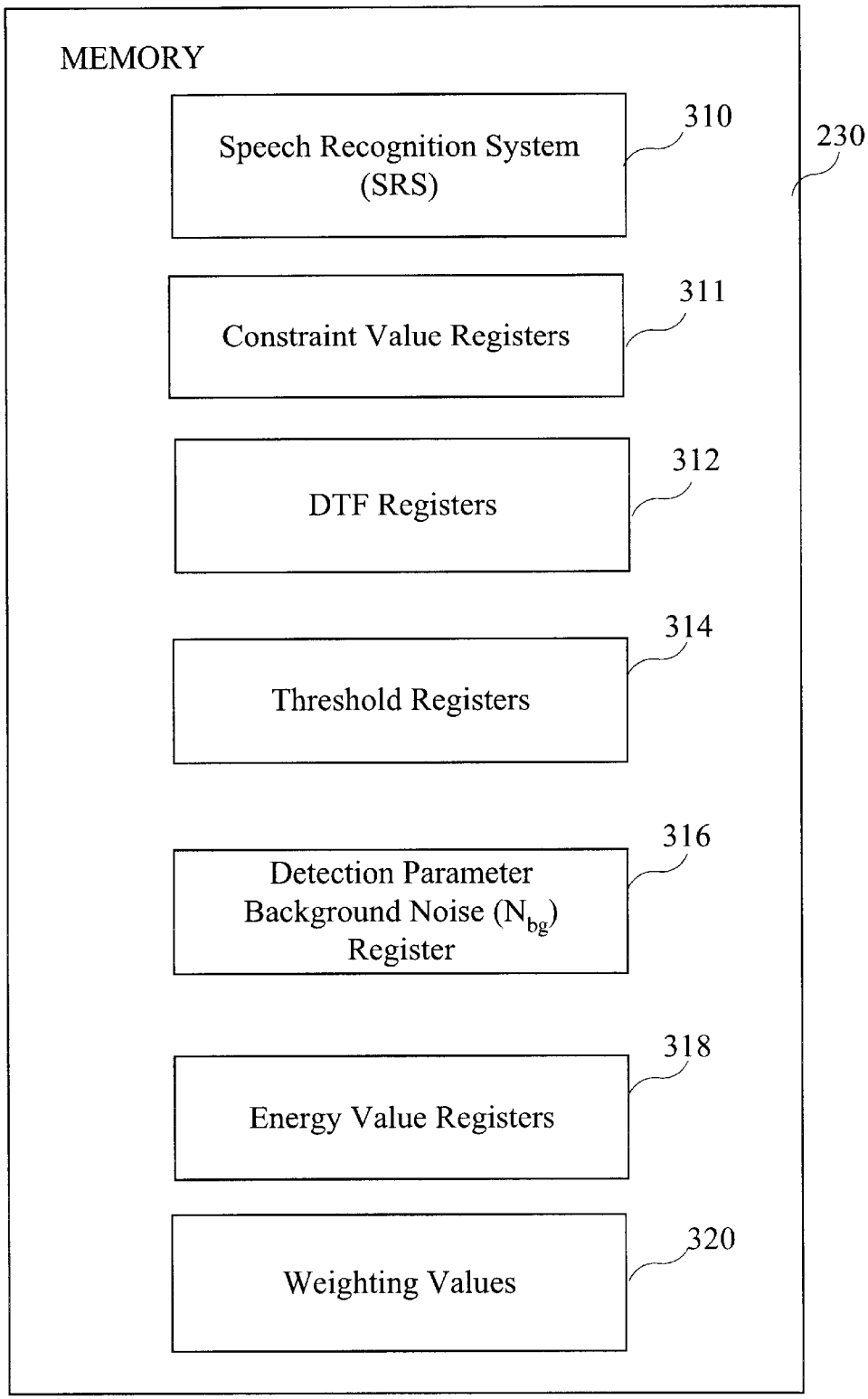
FIG. 3 is a block diagram of one embodiment for the memory of FIG. 2, in accordance with the present invention.

Referring now to FIG. 3, a block diagram of one embodiment for memory 230 of FIG. 2 is shown. Memory 230 may alternatively comprise various storage-device configurations, including Random-Access Memory (RAM) and non-volatile storage devices such as floppy-disks or hard disk-drives. In the FIG. 3 embodiment, memory 230 includes a speech recognition system (SRS) 310, constraint value registers 311, dynamic time-frequency parameter (DTF) registers 312, threshold registers 314, detection parameter background noise ($N_{bg}$) register 316, energy value registers 318, and weighting values 320.

In the preferred embodiment, speech recognition system 310 includes a series of software modules which are executed by CPU 228 to detect and analyze speech data, and which are further described below in conjunction with FIG. 4. In alternate embodiments, speech recognition system 310 may readily be implemented using various other software and/or hardware configurations. Constraint value registers 311, dynamic time-frequency parameter (DTF) registers 312, threshold registers 314, detection parameter background noise ($N_{bg}$) register 316, energy value registers 318, and weighting values 320 preferably contain respective values which are calculated and utilized by speech recognition system 310 to determine the beginning and ending points of a spoken utterance according to the present invention. The contents of DTF registers 312 and weighting values 320 are further described below in conjunction with FIGS. 6–7. The contents of detection parameter background noise register 316 is further described below in conjunction with FIG. 8. The contents of threshold registers 314 and E value registers 318 are further described below in conjunction with FIG. 9(*b*). The contents and use of constraint value registers 311 are further described below in conjunction with FIG. 13.

Figure 4:
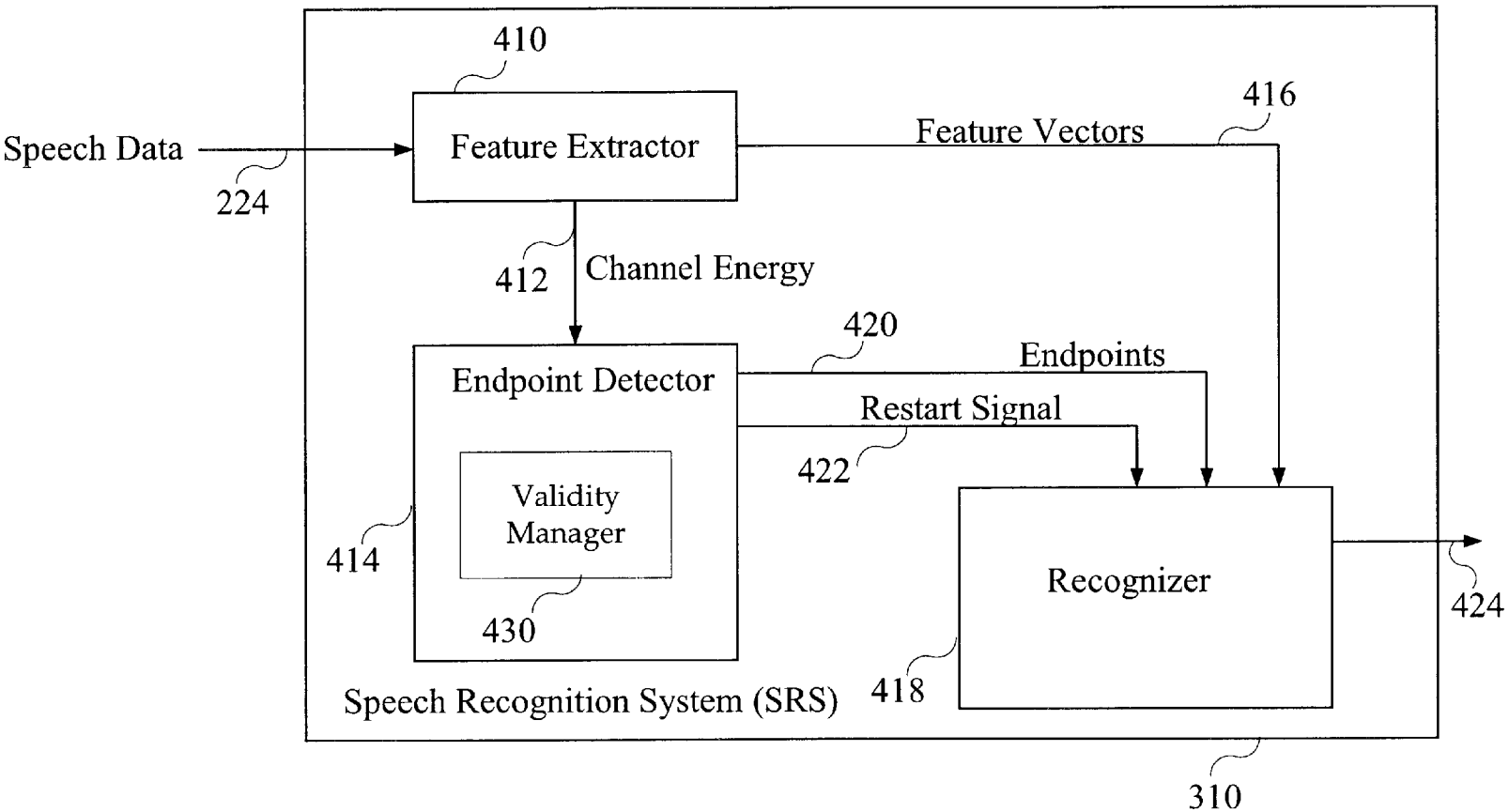
FIG. 4 is a block diagram of one embodiment for the speech recognition system of FIG. 3.

Referring now to FIG. 4, a block diagram of the preferred embodiment for the FIG. 3 speech recognition system 310 is shown. In the FIG. 3 embodiment, speech recognition system 310 includes a feature extractor 410, an endpoint detector 414, and a recognizer 418.

In operation, analog-to-digital converter 220 (FIG. 2) provides digital speech data to feature extractor 410 within speech recognition system 310 via system bus 224. A high-pass filtering system in feature extractor 410 may therefore be used to emphasize high-frequency components of human speech, as well as to reduce low-frequency background noise levels.

Within feature extractor 410, a buffer memory temporarily stores the speech data before passing the speech data to a pre-emphasis module which preferably pre-emphasizes the speech data as defined by the following equation:

$$xl(n)=x(n)-0.97x(n-1)$$

where x(n) is the speech data signal and xl(n) is the pre-emphasized speech data signal.

A filter bank in feature extractor 410 then receives the pre-emphasized speech data and responsively generates channel energy which is provided to endpoint detector 414 via line 412. In the preferred embodiment, the filter bank in feature extractor 410 is a mel-frequency scaled filter bank which is further described below in conjunction with FIG. 6. The channel energy from the filter bank in feature extractor 410 is also provided to a feature vector calculator in feature extractor 410 to generate feature vectors which are then provided to recognizer 418 via line 416. In the preferred embodiment, the feature vector calculator is a mel-scaled frequency capture (mfcc) feature vector calculator.

In accordance with the present invention, endpoint detector 414 analyzes the channel energy received from feature extractor 410 and responsively determines endpoints (beginning and ending points) for the particular spoken utterance represented by the channel energy received on line 412. The preferred method for determining endpoints is further discussed below in conjunction with FIGS. 5–13. In accordance with the present invention, endpoint detector 414 may utilize validity manager 430 to verify that particular speech energy is a valid utterance.

Endpoint detector 414 then provides the calculated endpoints to recognizer 418 via line 420 and may also, under certain conditions, provide a restart signal to recognizer 418 via line 422. The generation and function of the restart signal on line 422 is further discussed below in conjunction with FIG. 10. Recognizer 418 receives feature vectors on line 416 and endpoints on line 420 and responsively performs a speech recognition procedure to advantageously generate a speech recognition result to CPU 228 via line 424.

Figure 5:
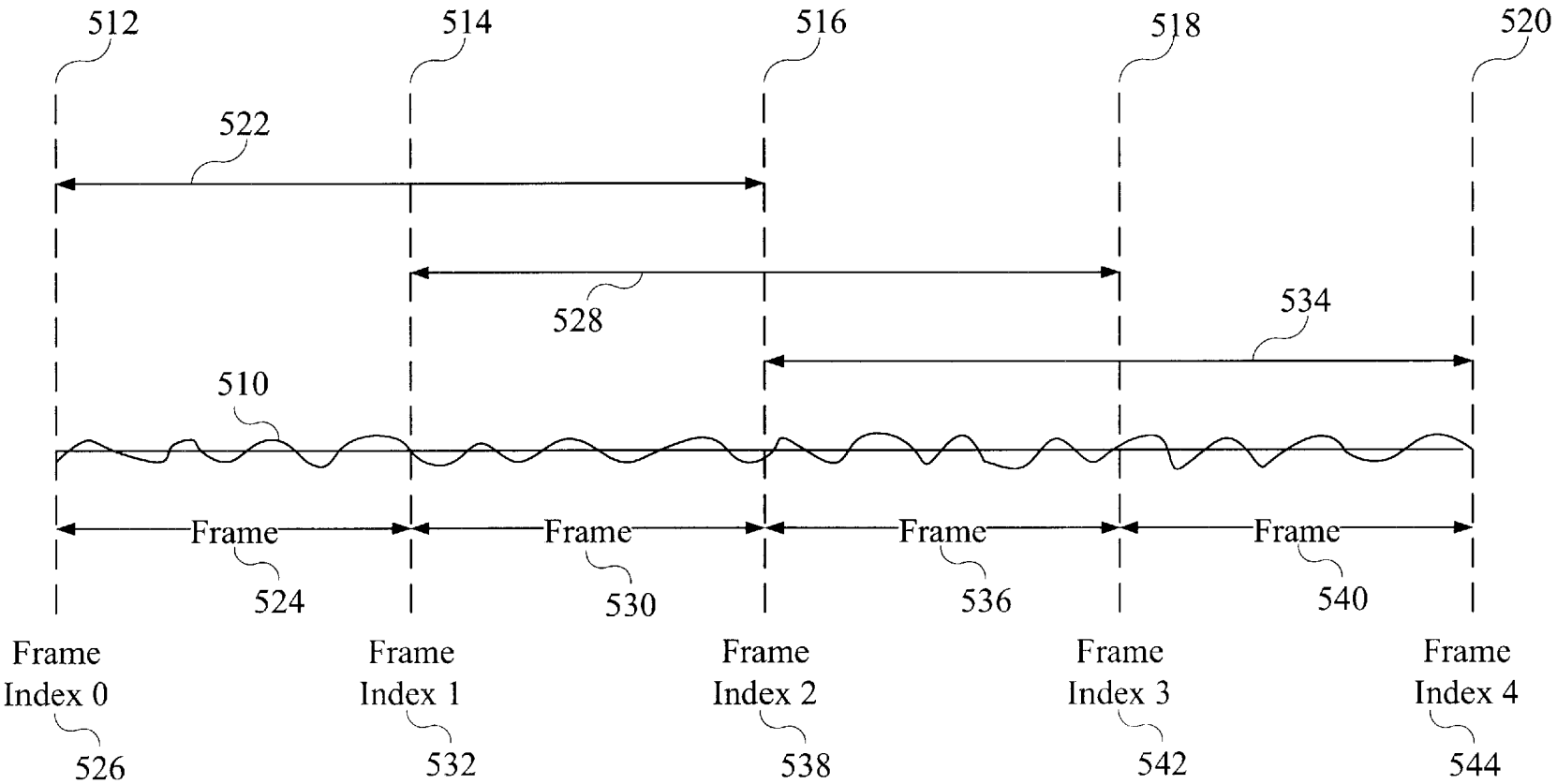
FIG. 5 is a timing diagram showing frames of speech energy, in accordance with the present invention.

Referring now to FIG. 5, a timing diagram showing frames of speech energy is shown, in accordance with the present invention. FIG. 5 includes speech energy 510 which extends from time 512 to time 520 and which is presented for purposes of illustration only. In the preferred embodiment, speech energy 510 may be divided into a series of overlapping windows which have durations of 20 milliseconds, and which begin at 10 millisecond intervals. For example, a first window 522 begins at time 512 and ends at time 516, a second window 528 begins at time 514 and ends at time 518, and a third window 534 begins at time 516 and ends at time 520.

In the preferred embodiment, the first half of each window forms a 10-millisecond frame. In FIG. 5, a first frame 524 begins at time 512 and ends at time 514, a second frame 530 begins at time 514 and ends at time 516, a third frame 536 begins at time 516 and ends at time 518, and a fourth frame 540 begins at time 518 and ends at time 520. In FIG. 5, only four frames 524, 530, 536 and 540 are shown for purposes of illustration. In practice, however, the present invention typically uses significantly greater numbers of consecutive frames depending upon the duration of speech energy 510.

Speech energy 510 is thus sampled with a repeating series of contiguous 10-millisecond frames which occur at a constant frequency.

In the preferred embodiment, each frame is uniquely associated with a corresponding frame index. In FIG. 5, the first frame 524 is associated with frame index 0 (526) at time 512, the second frame 530 is associated with frame index 1 (532) at time 514, the third frame 536 is associated with frame index 2 (538) at time 516, and the fourth frame is associated with frame index 3 (542) at time 518. The relative location of a particular frame in speech energy 510 may thus be identified by reference to the corresponding frame index.

Figure 6:
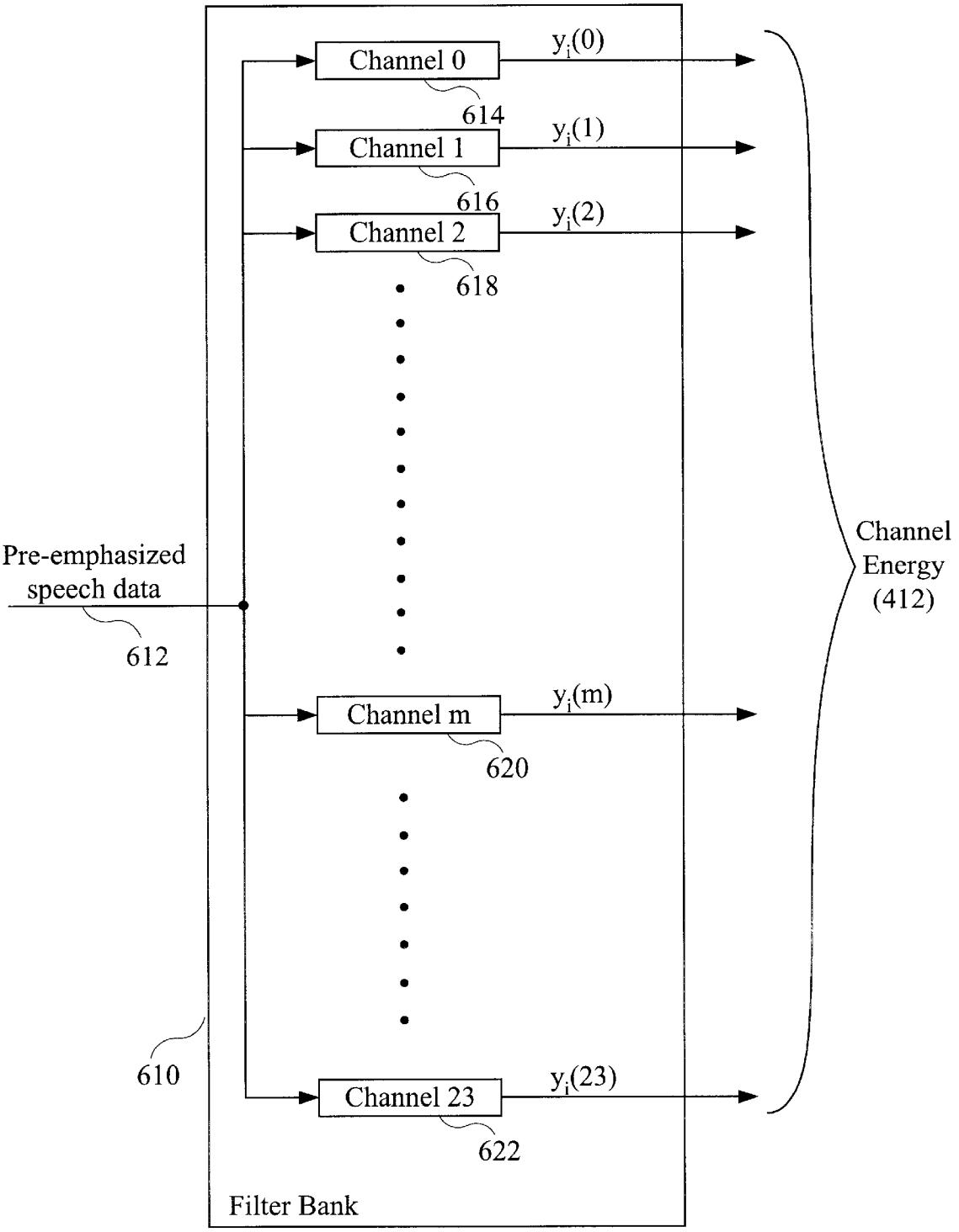
FIG. 6 is a schematic diagram of one embodiment for the filter bank of the FIG. 4 feature extractor.

Referring now to FIG. 6, a schematic diagram of one embodiment for filter bank 610 of feature extractor 410 (FIG. 4) is shown. In one embodiment, filter bank 610 is a mel-frequency scaled filter bank with twenty four channels (channel 0 (614) through channel 23 (622)). In alternate embodiments, various other implementations of filter bank 610 are equally possible.

In operation, filter bank 610 receives pre-emphasized speech data via line 612 and provides the speech data in parallel to channel 0 (614) through channel 23 (622). In response, channel 0 (614) through channel 23 (622) generate respective filter output energies $y_i(0)$ through $y_i(23)$ which collectively form the channel energy provided to endpoint detector via line 412 (FIG. 4).

The output energy of a selected channel m 620 of filter bank 610 may be represented by the variable $y_i(m)$ which is preferably calculated using the following equation:

$$y_i(m) = \sum_k (h_m(k)y_i'(k))^2,\ m = 0, \ldots, 19$$

where $y_i(m)$ is the output energy of the m-th channel 620 filter at frame index i, and $h_m(k)$ is the m-th channel 620 triangle filter designed based on the mel-frequency scale represented by the following equation:

$$Mel(f) = 2595\log_{10}\left(1 + \frac{f}{700}\right)$$

where the range of the frequency band is from 200 Hertz to 5500 Hertz. The variable $y_i'(k)$ above is preferably calculated using the following equation:

$$y_i'(k)=FFT_{512}(x_i(l)W_h(l))$$

where $x_i(l)$ is the i-th frame-index speech segment with window size L=20 milliseconds which is zero-padded to fit a Fast Fourier Transform (FFT) length of 512 points, and where $w_h(l)$ is a hanning window of speech data.

Filter bank 610 in feature extractor 410 thus processes the pre-emphasized speech data received on line 612 to generate and provide channel energy to endpoint detector 414 via line 412. Endpoint detector 414 may then advantageously detect the beginning and ending points of the spoken utterance represented by the received channel energy, in accordance with the present invention.

Figure 7:
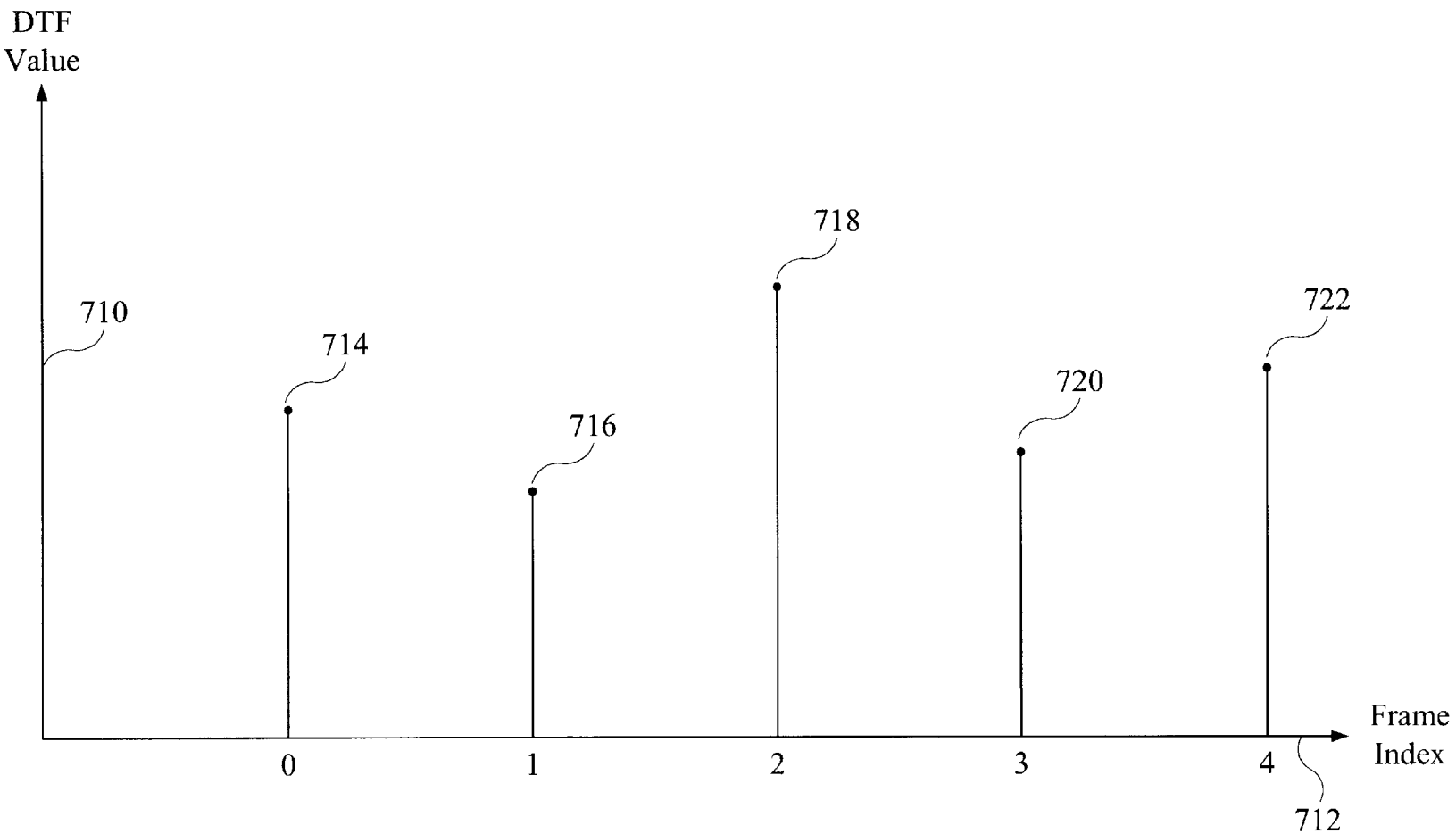
FIG. 7 is a graph of exemplary DTF values illustrating a five-point median filter, according to the present invention.

Referring now to FIG. 7, a graph of exemplary DTF values illustrating a five-point median filter is shown. In one embodiment of the present invention, endpoint detector 414 uses short-term energy as detection parameters (hereafter referred to as the dynamic time-frequency parameter (DTF)) to robustly detect the beginning and ending points of an utterance.

In one embodiment, the DTF detection parameters may preferably be calculated using the following equation:

$$DTF(i) = \sum_m \left| \sum_{t=1}^{2} l(y_{i+l}(m) - y_{i-l}(m)) \right| \Big/ 10$$

where $y_i(m)$ is the m-th channel 620 output energy of the mel-frequency spaced filter-bank 610 (FIG. 6) at frame index i, as discussed above in conjunction with FIG. 6. Channel m 620 may be selected from any one of the channels within filter bank 610.

In another embodiment, the DTF parameters may preferably be calculated using the following equation:

$$DTF(i) = \sum_{m=0}^{M-1} y_i(m)w_i(m)$$

where $w_i(m)$ is a respective weighting value, $y_i(m)$ is channel signal energy of channel m at frame i, and M is the total number of channels of filter bank 610. Channel m 620 (FIG. 6) may be any one of the channels of filter bank 610. Furthermore, in alternate embodiments, the present invention may readily calculate and utilize other types of energy parameters to effectively perform speech recognition techniques, in accordance with the present invention.

In the FIG. 7 embodiment, endpoint detector 414 preferably weights the channel speech energy from filter bank 610 with weighting values $w_i(m)$ that are adapted to the channel background noise data to thereby advantageously increase the signal-to-noise ratio (SNR) of the channel energy. In order to obtain a high overall SNR, the channel energy from those channels with a high SNR should preferably be weighted highly to produce noise-suppressed channel energy. In other words, the weighting values are preferably proportional to the SNRs of the respective channel energies.

Various techniques for effectively deriving weighting values $w_i(m)$ are further discussed in co-pending U.S. patent application Ser. No. 09/176,178, entitled "Method For Suppressing Background Noise In A Speech Detection System," filed on Oct. 21, 1998, and in to co-pending U.S. Provisional Patent Application Serial No. 60/160,842, entitled "Method For Implementing A Noise Suppressor In A Speech Recognition System," filed on Oct. 21, 1999.

Endpoint detector 414 thus calculates, in real time, separate DTF parameters which each correspond with an associated frame of speech data received from feature extractor 410. The DTF parameters provide noise cancellation due to use of weighting values $w_i(m)$ in the foregoing DTF parameter calculation. Speech recognition system 310 therefore advantageously exhibits reduced sensitivity to many types of ambient background noise DTF'(i) is then smoothed by the 5-point median filter illustrated in FIG. 7 to obtain the preferred short-term energy parameter DTF(i). The FIG. 7 graph displays DTF values on vertical axis 710 and frame index values on horizontal axis 712. In practice, a current DTF parameter is generated by calculating the median value of the current DTF parameter in combination with the four immediately preceding DTF parameters. In the FIG. 7 example, the current DTF parameter is thus calculated by finding the median of values 714, 716, 718, 720 and 722. The preferred parameter DTF(i) may thus be expressed with the following equation:

$$DTF(i)=MedianFilter(\sqrt{DTF'(i)}).$$

Figure 8:
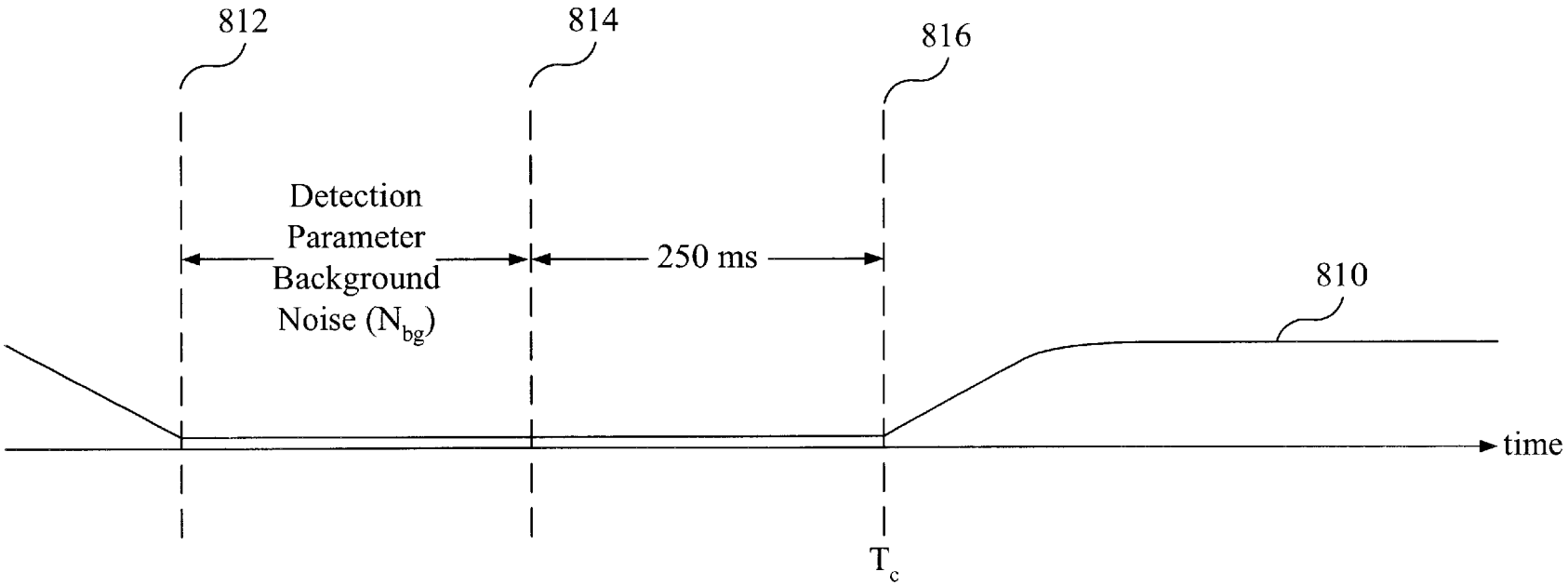
FIG. 8 is a diagram of speech energy illustrating the calculation of background noise ($N_{bg}$), according to one embodiment of the present invention.

Referring now to FIG. 8, a diagram of speech energy 810 illustrating the calculation of detection parameter background noise ($N_{bg}$) is shown, according to the present invention. In the preferred embodiment, detection parameter background noise ($N_{bg}$) is derived by calculating the DTF parameters for a segment of the speech energy 810 which satisfies two conditions. The first condition requires that endpoint detector 414 calculate $N_{bg}$ from a segment of speech energy 810 that is at least 250 milliseconds ahead of the beginning point of a reliable island in speech energy 810.

In the FIG. 8 example, the beginning point of a reliable island in speech energy 810 is shown as $T_c$ at time 816. Endpoint detector 414 thus preferably calculates $N_{bg}$ from time 812 to time 814, in order to maintain 250 milliseconds between the detection parameter background noise segment ending at time 814 and the beginning point $t_c$ of the reliable island shown at time 816.

The second condition for calculating $N_{bg}$ requires that the normalized deviation (ND) for the background noise segment of speech energy 810 be less than a pre-determined constant value. In the preferred embodiment, the normalized deviation ND is defined by the following equation:

$$ND = \frac{\sqrt{\frac{1}{L}\sum_i (DTF(i) - \underline{DTF})^2}}{\underline{DTF} + const}$$

where DTF is the average of DTF(i) over the estimated background noise segment of speech energy 810 and L is the number of frames in the same background noise segment of speech energy 810.

Figure 9A:
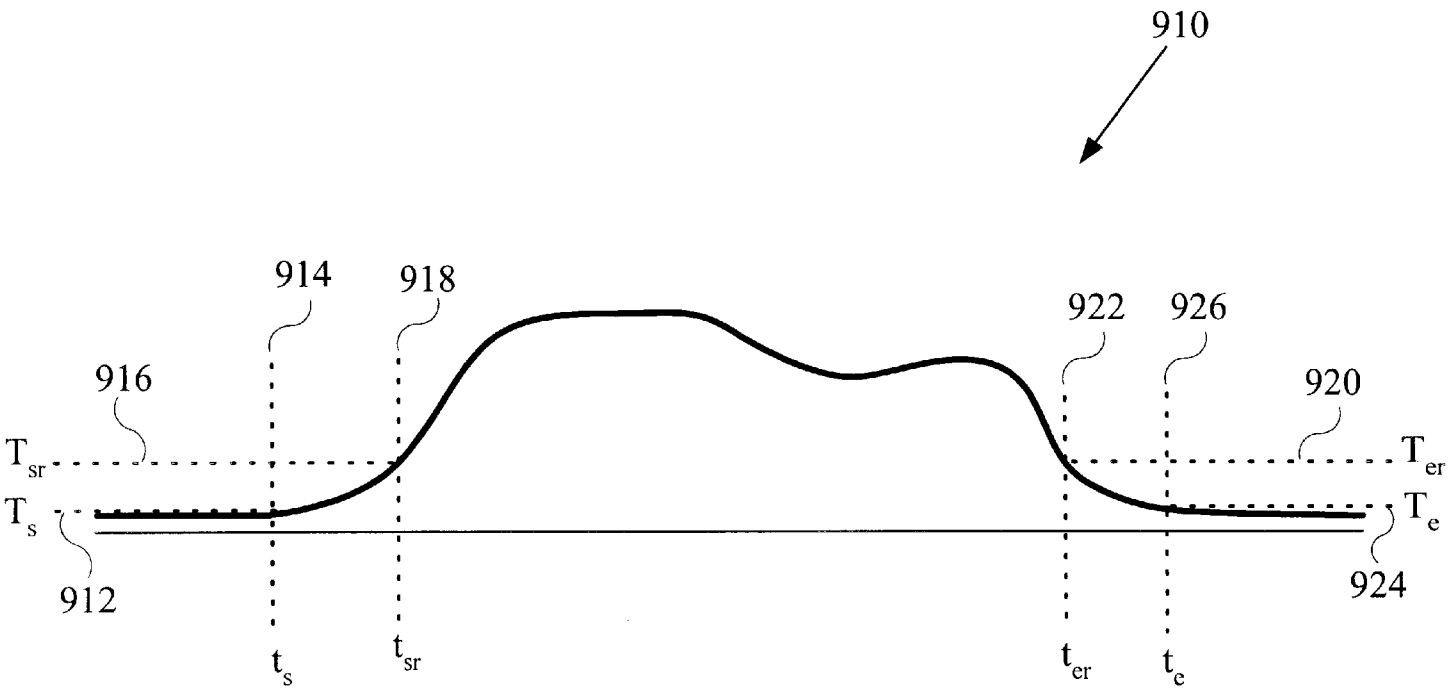
FIG. 9(*a*) is a diagram of exemplary speech energy, including a reliable island and thresholds, in accordance with one embodiment of the present invention.
Figure 9B:
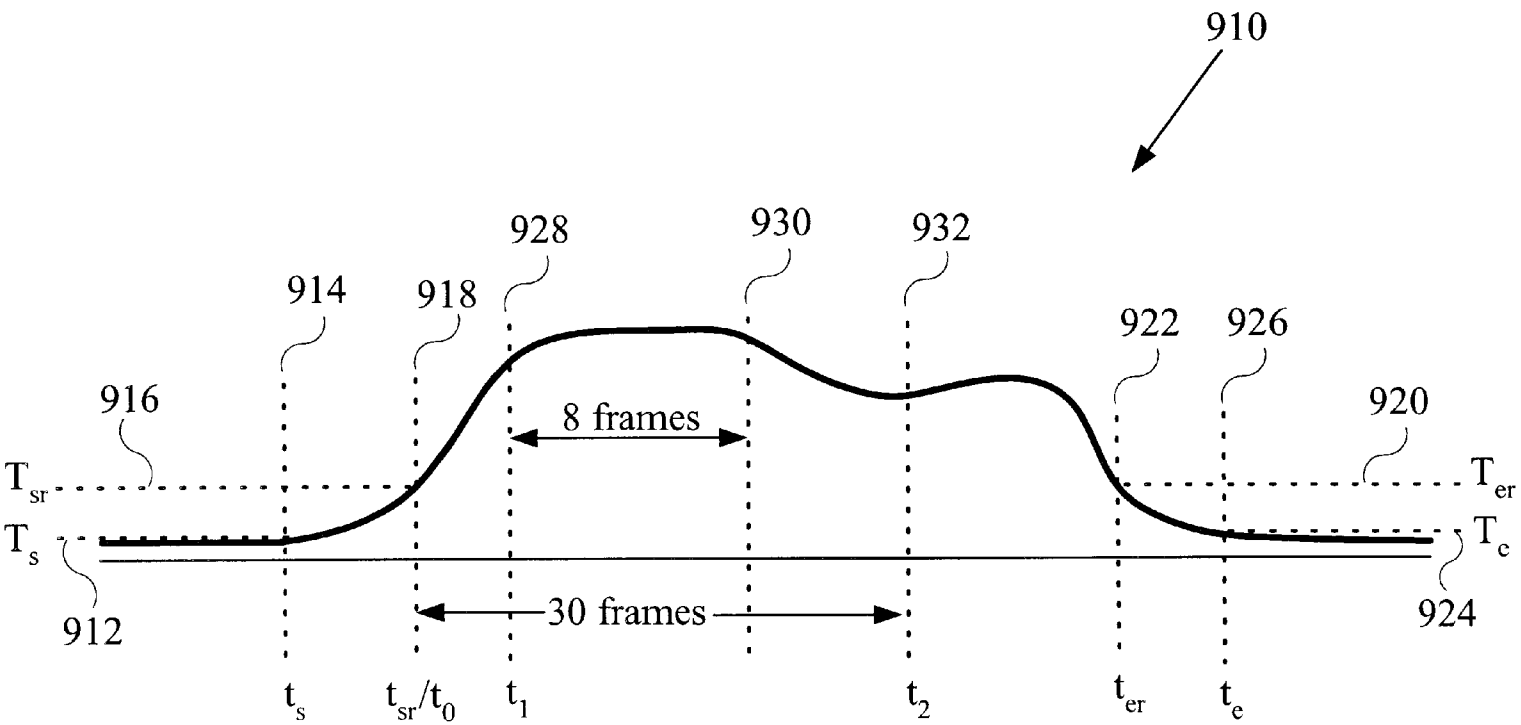

Referring now to FIG. 9(*a*), a diagram of exemplary speech energy 910 is shown, including a reliable island and four thresholds, in accordance with the present invention. Speech energy 910 represents an exemplary spoken utterance which has a beginning point ts shown at time 914 and an ending point $t_e$ shown at time 926. In the preferred embodiment, threshold $T_s$ 912 is used to refine the beginning point $t_s$ of speech energy 910, and threshold $T_e$ 924 is used to refine the ending point of speech energy 910. The waveform of the FIG. 9(*a*) speech energy 910 is presented for purposes of illustration only and may alternatively comprise various other waveforms.

Speech energy 910 also includes a reliable island region which has a starting point $t_{sr}$ shown at time 918, and a stopping point ter shown at time 922. In the preferred embodiment, threshold $T_{sr}$ 916 is used to detect the starting point $t_{sr}$ of the reliable island in speech energy 910, and threshold $T_{er}$ 920 is used to detect the stopping point of the reliable island in speech energy 910. In operation, endpoint detector 414 repeatedly recalculates the foregoing thresholds ($T_s$ 912, $T_e$ 920, $T_{sr}$ 916, and $T_{er}$ 920) in real time to correctly locate the beginning point $t_s$ and the ending point $t_e$ of speech energy 910.

Referring now to FIG. 9(*b*), a diagram of exemplary speech energy 910 is shown, illustrating the calculation of threshold values, in accordance with the present invention. In one embodiment, thresholds $T_s$ 912, $T_e$ 920, $T_{sr}$ 916, and $T_{er}$ 920 are adaptive to detection parameter background noise ($N_{bg}$) values and the signal-to-noise ratio (SNR). In one embodiment, calculation of the SNR values require endpoint detector 414 to determine a series of energy values $E_{le}$ which represent maximum average speech energy at various points along speech energy 910. To calculate values for $E_{le}$, a low-pass filter may be applied to the DTF parameters to obtain current average energy values "CEle." The low-pass filtering may preferably be implemented recursively for each frame according to the following formula:

$$CEle_i = \alpha CEle_{i-1} + (1-\alpha)\, DTF$$

where $CEle_i$ is the current average energy value at frame i, and $\alpha$ is a forgetting factor. In one embodiment, $\alpha$ may be equal to 0.7618606 to simulate an eight-point rectangular window.

For real-time implementation, only the local or current SNR value is available. The SNR value for a beginning point $SNR_{ls}$ is estimated after the beginning point $t_{sr}$ of a reliable island has been detected as shown at time 918. The beginning point $SNR_{ls}$ is preferably calculated using the following equation:

$$SNR_{ls} = (E_{le} - N_{bg})/N_{bg}$$

where $E_{le}$ is the maximum average energy calculated over the previous DTF parameters shown from time 918 to time 932 of FIG. 9(*b*). The 8-frame maximum average of $E_{le}$ is searched for within the 30-frame window shown from time $t_0$ at time 918 and time $t_2$ at time 932. In one embodiment,. $E_{le}$ for calculating the beginning point $SNR_{ls}$ may be defined by the following equation:

$$E_{le} = \underset{i}{\mathrm{Max}}(CEle_i),\ i = t_0, \ldots, t_2$$

where $t_0$ is the start of the 30-frame window shown at time 918, and $t_2$ is the end of the 30-frame window shown at time 932.

Similarly, the SNR value for the ending point $SNR_{le}$ may preferably be estimated during the real-time process of searching for the ending point $t_{er}$ of a reliable island shown at time 922. The $SNR_{le}$ value may preferably be calculated and defined using the following equation:

$$SNR_{le} = (E_{le} - N_{bg})/N_{bg}$$

where $E_{le}$ is the current maximum average energy as endpoint detector 414 advances to process sequential frames of speech energy 910 in real-time. $E_{le}$ for ending point $SNR_{le}$ may preferably be derived in a similar manner as beginning point $SNR_{ls}$, and may preferably be defined using the following equation:

$$E_{le} = \underset{i}{\mathrm{Max}}(CEle_i),\ i = t_0, \ldots, t_c$$

where to is the start of a 30-frame window used in calculating $SNR_{ls}$, and $t_c$ is the current time frame index to search for the endpoint of the utterance.

When endpoint detector 414 has calculated $SNR_{ls}$ and $SNR_{le}$, as described above, and detection parameter background noise $N_{bg}$ has been determined, then thresholds $T_s$ 912 and $T_e$ 926 can be defined using the following equations:

$$T_s = N_{bg}(1 + SNR_{ls}/c_s)$$

$$T_e = N_{bg}(1 + SNR_{le}/c_e)$$

where $c_s$ is a constant for the beginning point determination, and $c_e$ is a constant for the ending point determination.

Thresholds $T_{sr}$ 916 and $T_{er}$ 920 can be determined using a methodology which is similar to that used to determine thresholds $T_s$ 912 and $T_e$ 926. In a real-time implementation, since $SNR_{ls}$ is not available to determine $T_{sr}$ 916, a SNR value is assumed. In the preferred embodiment, thresholds $T_{sr}$ 916 and $T_{er}$ 920 may be defined using the following equations:

$$T_{sr} = N_{bg}(1 + SNR_{ls}/c_{sr})$$

$$T_{er} = N_{bg}(1 + SNR_{le}/c_{er})$$

where $c_{sr}$ and $c_{er}$ are selectably pre-determined constant values. For conditions of unstable noise, thresholds $T_{sr}$ 916 and $T_{er}$ 920 may be further refined according to the following equations:

$$T_{sr} = N_{bg}(1 + SNR_{ls}/c_{sr}) + f(N_w) + c_l V_{bg}$$

$$T_{er} = N_{bg}(1 + SNR_{le}/c_{er}) + f(N_w) + c_l V_{bg}$$

where $N_w$, defined below, is a parameter related to the gain that is imposed on the DTF due to weight vector w, and $V_{bg}$ is a sample standard deviation of the background noise. The foregoing value f(.) may be defined by the following formula:

$$f(x) = C_2(1 - e^{(-c3x)})$$

Weight vector "w" is an adaptive parameter, whose values depend upon environmental conditions. Since the weight vector affects the magnitude of the DTF values, detection thresholds should also be adjusted according to the weighting values. For a given channel of filter bank 610, when the weighting value is small, after weighting, both noise and speech are suppressed. Since speech energy is not evenly distributed over the entire frequency band, weighting therefore has a different effect on different channels of filter bank 610. To compensate for the foregoing effect when adjusting detection thresholds, the weighting value "w" may preferably be multiplied by a speech energy distribution value "sw(m)". The speech energy distribution may be denoted as sw(m), m=0, 1, . . . , M−1. The foregoing value of $N_w$ may therefore be defined by the following equation:

$$N_w = \sum_{m=0}^{P} w(m)sw(m)$$

where P is less than M. In one embodiment, P may be equal to 13, M may be equal to 24, and the frequency band may be from 200 Hz to 5500 Hz.

In accordance with the present invention, endpoint detector 414 repeatedly updates the foregoing SNR values and threshold values as the real-time processing of speech energy 910 progresses.

Figure 10:
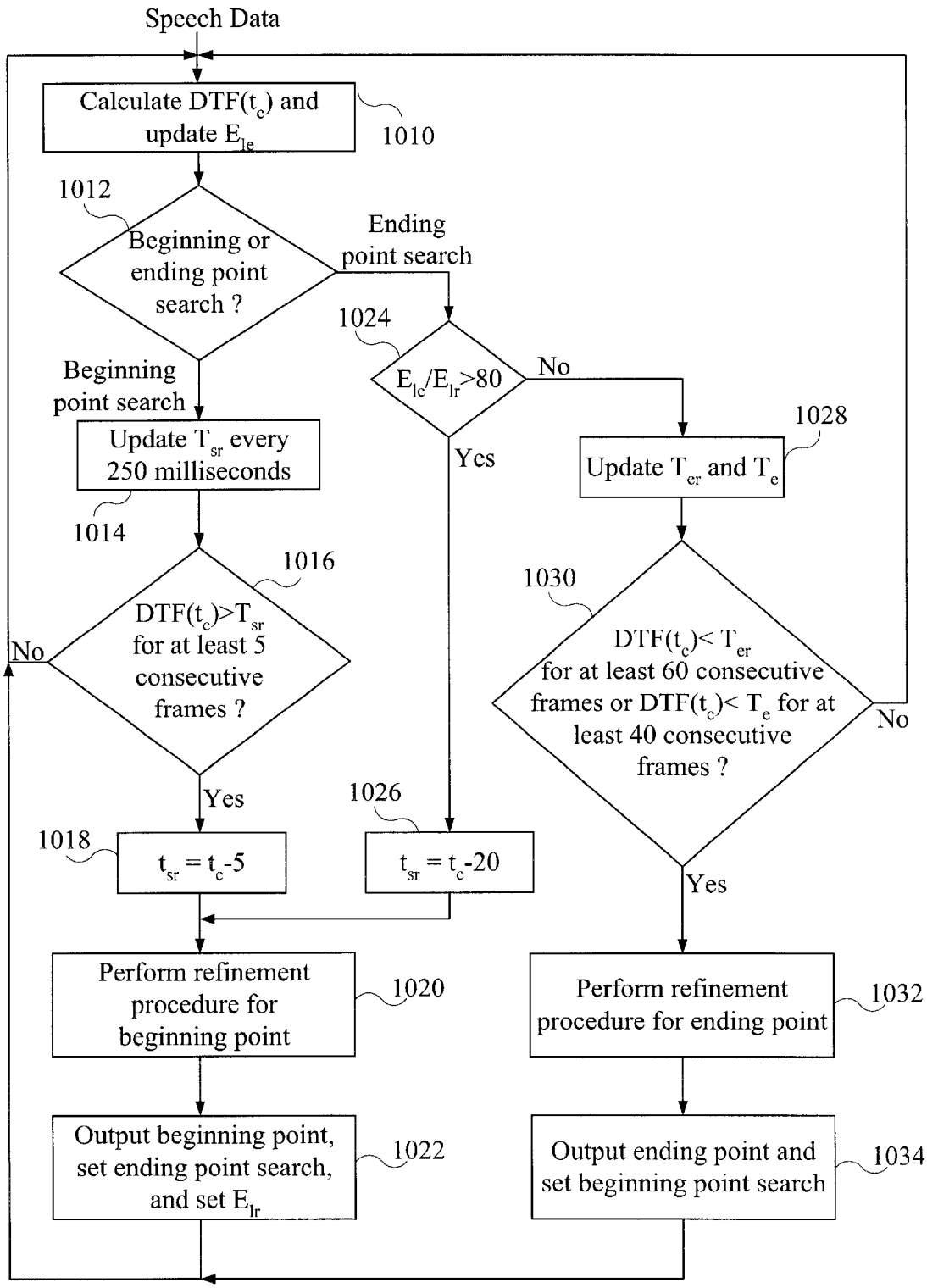
FIG. 10 is a flowchart of method steps for detecting the endpoints of a spoken utterance, according to one embodiment of the present invention.

Referring now to FIG. 10, a flowchart of preferred method steps for detecting the endpoints of a spoken utterance is shown, in accordance with the present invention. The FIG. 10 method first preferably detects a reliable island of speech energy, and then refines the boundaries (beginning and ending points) of the spoken utterance. The starting point of the reliable island ($t_{sr}$) is detected when the calculated DTF(i) parameter is first greater than threshold $T_{sr}$ 916 for at least five frames. In alternate embodiments, various values such as the foregoing value of 5 frames may be set to values other than those specifically discussed in conjunction with the FIG. 10 embodiment. The stopping point of the reliable island ($t_{er}$) is detected when the calculated DTF(i) value is less than threshold $T_{er}$ 922 for at least 60 frames (600 milliseconds) or less than threshold $T_e$ 924 for at least 40 frames (400 milliseconds).

After the starting point $t_{sr}$ of the reliable island is detected, a backward-searching (or refinement) procedure is used to find the beginning point $t_s$ of the spoken utterance. The searching range for this refinement procedure is limited to thirty-five frames (350 milliseconds) from the starting point $t_{sr}$ of the reliable island. The beginning point $t_s$ of the utterance is found when the calculated DTF(i) parameter is less than threshold $T_s$ 912 for at least seven frames. Similarly, the ending point $t_e$ of the spoken utterance may be identified when the current DTF(i) parameter is less than an ending threshold $T_e$ for a predetermined number of frames.

In some cases, speech recognition system 310 may mistake breathing noise for actual speech. In this case, the speech energy during the breathing period typically has a high SNR. To eliminate this type of error, the ratio of the current $E_{le}$ to a value of $E_{lr}$ is monitored by endpoint detector 414. If the starting point $t_{sr}$ of the reliable island is initially obtained from the breathing noise, then $E_{lr}$ is usually a relatively small value and the ratio of $E_{le}$ to $E_{lr}$ will be high when an updated $E_{le}$ is calculated using the actual speech utterance. A predetermined restart threshold level is selected, and if the $E_{le}$ to $E_{lr}$ ratio is greater than the predetermined restart threshold, then endpoint detector 414 determines that the previous starting point $t_{sr}$ of the reliable island is not accurate. Endpoint detector 414 then sends a restart signal to recognizer 418 to initialize the speech recognition process, and then re-examines the beginning segment of the utterance to identify a true reliable island.

In FIG. 10, speech recognition system 310 initially receives speech data from analog-to digital converter 220 via system bus 224 and responsively processes the speech data to provide channel energy to endpoint detector 414, as discussed above in conjunction with FIG. 6. In step 1010, endpoint detector 414 calculates a current DTF(tc) parameter (where $t_c$ is the current frame index) as discussed above in conjunction with FIG. 7, and then preferably stores the calculated DTF($t_c$) parameter into DTF registers 312 (FIG. 3). Also in step 1010, endpoint detector 414 calculates a current $E_{le}$ value as discussed above in conjunction with FIG. 9(*b*), and then preferably stores the updated $E_{le}$ value into E value registers 318.

In step 1012, endpoint detector 414 determines whether to conduct a beginning point search or an ending point search. In practice, on the first pass through step 1012, endpoint detector 414 conducts a beginning point search. Following the first pass through step 1012, the FIG. 10 process continues until a beginning point $t_s$ is determined. Then, endpoint detector 414 switches to an ending point search. If endpoint detector 414 is currently performing a beginning point search, then in step 1014, endpoint detector 414 calculates a current threshold $T_{sr}$ 916 as discussed above in conjunction with FIG. 9(*b*), and preferably stores the calculated threshold $T_{sr}$ 916 into threshold registers 314. In subsequent passes through step 1014, endpoint detector 414 updates threshold $T_{sr}$ 916 if 250 milliseconds have elapsed since the previous update of $T_{sr}$ 916.

In step 1016, endpoint detector 414 determines whether the DTF($t_c$) value (calculated in step 1010) has been greater than threshold $T_{sr}$ 916 (calculated in step 1014) for at least five consecutive frames of speech energy 910. If the condition of step 1016 is not met, then the FIG. 10 process loops back to step 1010. If, however, the condition of step 1016 is met, then endpoint detector 414, in step 1018, sets the starting point $t_{sr}$ of the reliable island to a value equal to the current frame index $t_c$ minus 5.

In foregoing step 1016 of the FIG. 10 embodiment, validity manager 430 may also advantageously utilize a pulse width module 1310 to detect a valid reliable island during conditions where speech energy includes multiple speech energy pulses within a certain pre-determined time period "P". Therefore, validity manager 430 may preferably sum energy pulses (corresponding to a single pulse width values, and subject to pulse gap value constraints) to thereby produce a total pulse width value that validity manager 430 may then utilize to detect a beginning point for a reliable island whenever the total pulse width value is greater than a reliable island threshold $T_{sr}$ for a pre-determined time period "P". The functionality and use of a pulse width module is further discussed below in conjunction with the FIG. 13 embodiment of validity manager 430.

Next, in step 1020, endpoint detector 414 preferably performs the beginning-point refinement procedure discussed below in conjunction with FIG. 11 to locate beginning point $t_s$ of the spoken utterance. In step 1022, endpoint detector 414 outputs the beginning point $t_s$ to recognizer 418 and switches to an ending point search for the next pass through step 1012. In step 1022, endpoint detector 414 also sets a value $E_{lr}$ equal to an initial beginning point value of $E_{le}$ and preferably stores $E_{lr}$ into energy value registers 318.

The FIG. 10 process then returns to step 1010 and recalculates a new DTF($t_c$) parameter based on the current frame index, and also updates the value for $E_{le}$. Since a beginning point $t_s$ has been identified, endpoint detector 414, in step 1012, commences an ending point search. However, in step 1024, if the ratio of $E_{le}$ to $E_{lr}$ is greater than 80, then endpoint detector 414 sends a restart signal to recognizer 418 and, in step 1026, sets starting point $t_{sr}$ to a value equal to the current time index $t_c$ minus 20. The FIG. 10 process then advances to step 1020.

However, in step 1024, if the ratio of $E_{le}$ to $E_{lr}$ is not greater than the predetermined value 80, then endpoint detector 414, in step 1028, calculates a threshold $T_{er}$ 920 and a threshold $T_e$ 924 as discussed above in conjunction with FIG. 9(*b*). Endpoint detector 414 preferably stores the calculated thresholds $T_{er}$ 920 and $T_e$ 924 into threshold registers 314. In step 1030, endpoint detector 414 determines whether the current DTF($t_c$) parameter has been less than threshold $T_{er}$ 920 for at least sixty consecutive frames, or whether the current DTF($t_c$) parameter has been less than threshold $T_e$ 924 or at least 40 consecutive frames.

If neither of the conditions in step 1030 is met, then the FIG. 10 process loops back to step 1010. However, if either of the conditions of step 1030 is met, then endpoint detector 414, in step 1032, performs the ending-point refinement procedure discussed below in conjunction with FIG. 12 to locate ending point $t_e$ of the spoken utterance. In step 1034, endpoint detector 414 outputs the ending point $t_e$ to recognizer 418 and switches to a beginning point search for the next pass through step 1012. The FIG. 10 process then returns to step 1010 to advantageously perform endpoint detection on subsequent utterances.

Figure 11:
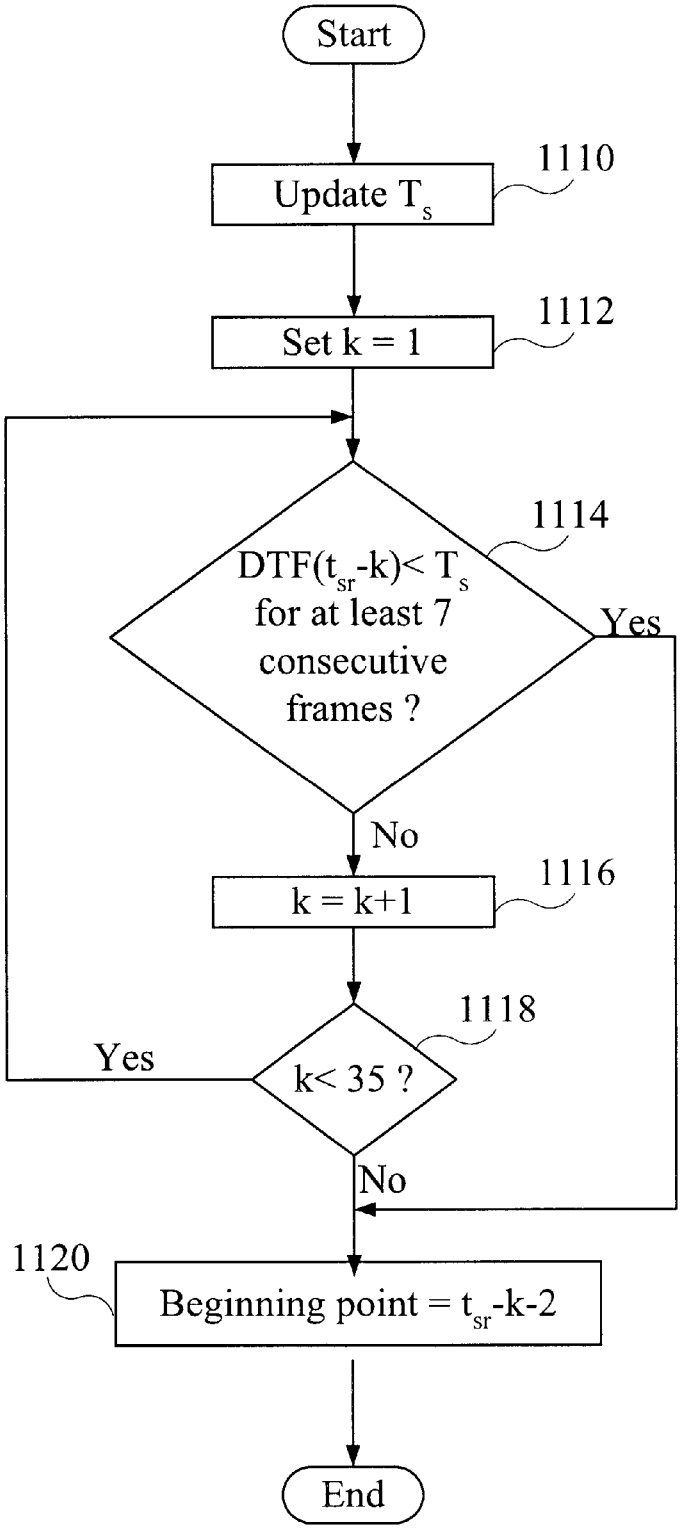
FIG. 11 is a flowchart of method steps for the beginning point refinement procedure of FIG. 10, according to one embodiment of the present invention.

Referring now to FIG. 11, a flowchart of preferred method steps for a beginning-point refinement procedure (step 1020 of FIG. 10) is shown. Initially, in step 1110, endpoint detector 414 calculates a current threshold $T_s$ 912 as discussed above in conjunction with FIG. 9(*b*), and preferably stores the updated threshold $T_s$ 912 into threshold registers 314. Then, in step 1112, endpoint detector 414 sets a value k equal to the value 1.

In step 1114, endpoint detector 414 determines whether the DTF($t_{sr}$−k) parameter has been less than threshold $T_s$ 912 for at least seven consecutive frames, where $t_{sr}$ is the starting point of the reliable island in speech energy 910 and k is the value set in step 1112. If the condition of step 1114 is satisfied, then the FIG. 11 process advances to step 1120. However, if the condition of step 1114 is not satisfied, then endpoint detector 414, in step 1116, increments the current value of k by the value 1 to equal k+1.

In step 1118, endpoint detector 414 determines whether the current value of k is less than the value 35. If k is less than 35, then the FIG. 11 process loops back to step 1114. However, if k not less than 35, then endpoint detector 414, in step 1120, sets the beginning point $t_s$ of the spoken utterance to the value $t_{sr}$−k−2, where $t_{sr}$ is the starting point of the reliable island in speech energy 910, k is the value set in step 1116, and the constant value 2 is a compensation value for delay from the median filter discussed above in conjunction with FIG. 7.

Figure 12:
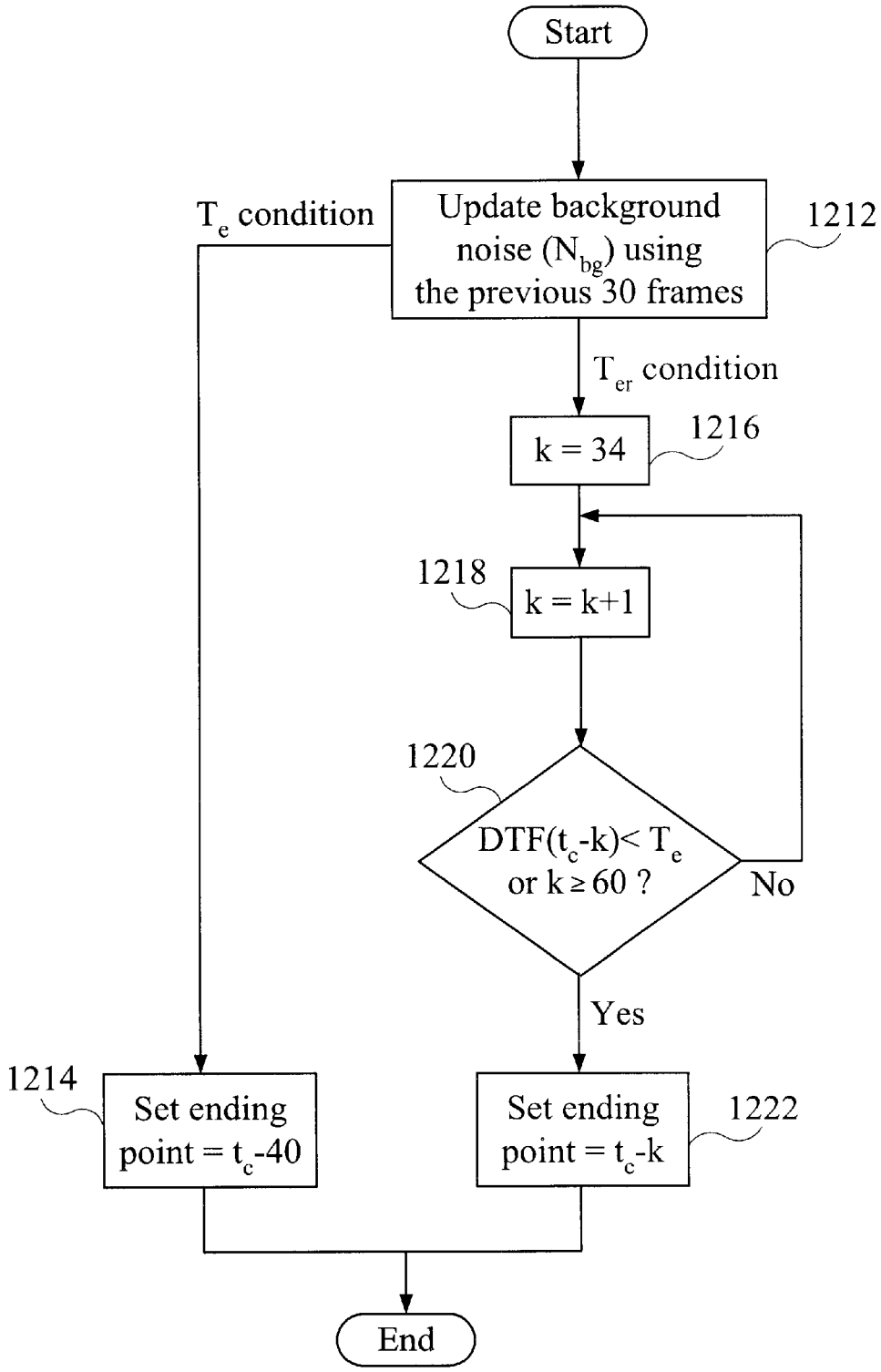
FIG. 12 is a flowchart of preferred method steps for the ending point refinement procedure of FIG. 10, according to one embodiment of the present invention.

Referring now to FIG. 12, a flowchart of preferred method steps for an ending-point refinement procedure (step 1032 of FIG. 10) is shown. Initially, endpoint detector 414 updates the detection parameter background noise value $N_{bg}$ using the previous thirty frames of speech energy 910 as a detection parameter background noise calculation period, and preferably stores the updated value $N_{bg}$ in detection parameter background noise register 316.

Next, endpoint detector 414 determines which condition was satisfied in step 1030 of FIG. 10. If step 1030 was satisfied by DTF($t_c$) being less than threshold $T_e$ 924 for at least forty consecutive frames, then endpoint detector 414, in step 1214, sets the ending point $t_e$ of the utterance to a value equal to the current frame index $t_c$ minus 40. However, if step 1030 of FIG. 10 was satisfied by DTF($t_c$) being less than threshold $T_{er}$ 922 for at least sixty consecutive frames, then endpoint detector 414, in step 1216, sets a value k equal to the value 34. Then, in step 1218, endpoint detector 414 increments the current value of k by the value 1 to equal k+1.

In step 1220, endpoint detector 414 check two separate conditions to determine either whether the DTF($t_c$−k) parameter is less than threshold $T_e$ 924, where $t_c$ is the current frame index and k is the value set in step 1218, or alternately, whether the value k from step 1218 is greater or equal to the value 60. If neither of the conditions in step 1220 are satisfied, then the FIG. 12 process loops back to step 1218. However, if either of the two conditions of step 1220 is satisfied, then endpoint detector 414 sets the ending point $t_e$ of the utterance to a value equal to $t_c$−k, where $t_c$ is the current frame index and k is the value set in step 1218.

Figure 13:
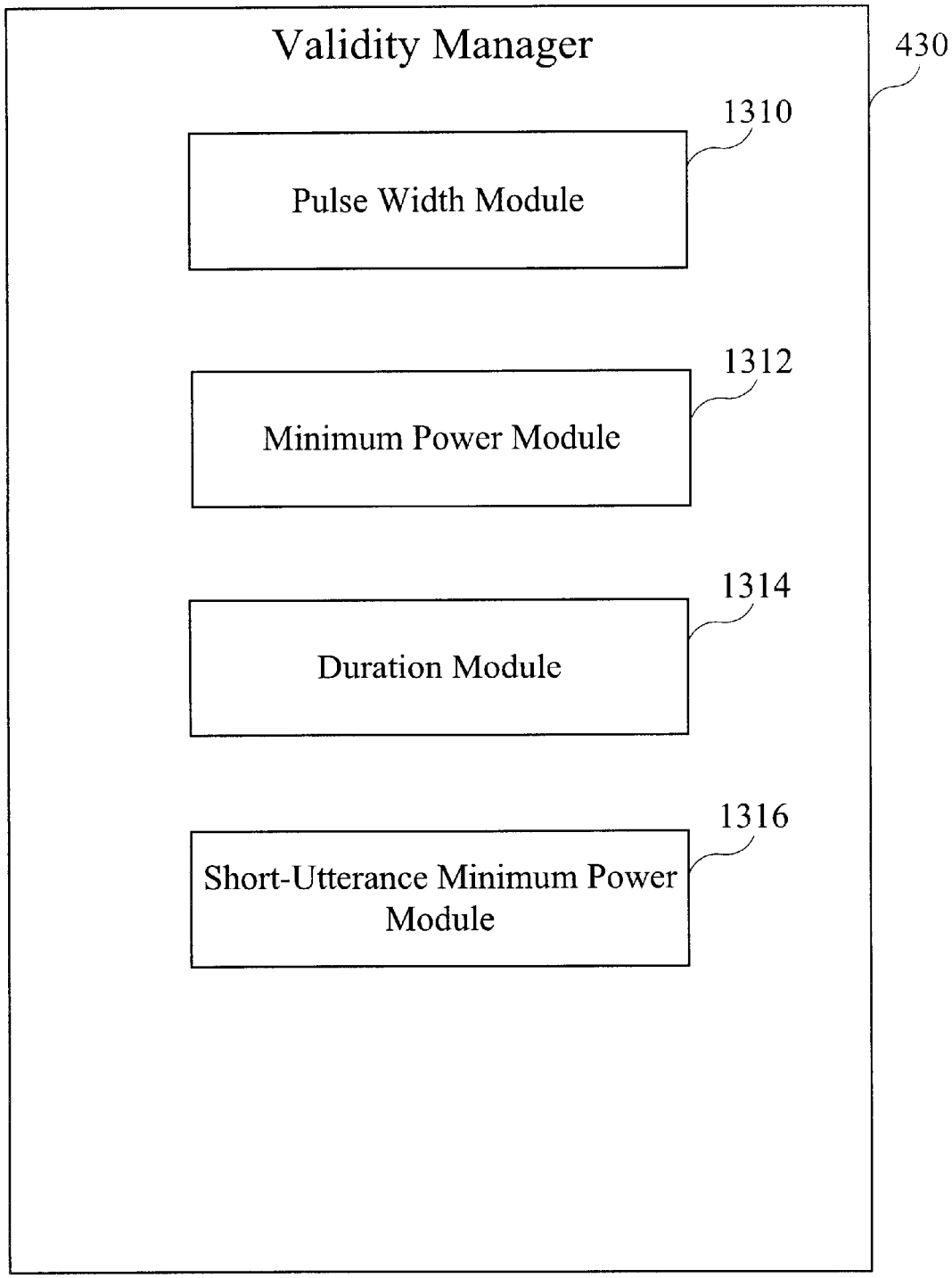
FIG. 13 is a flowchart of one embodiment for the validity manager of FIG. 4, in accordance with the present invention.

Referring now to FIG. 13, a block diagram for one embodiment of the FIG. 4 validity manager 430 is shown, in accordance with the present invention. In the FIG. 13 embodiment, validity manager 430 preferably includes, but is not limited to, at least one of a pulse width module 1310, a minimum power module 1312, a duration module 1314, and a short-utterance minimum power module 1316. In accordance with the present invention, pulse width module 1310, minimum power module 1312, duration module 1314, and short-utterance minimum power module 1316 each analyze speech utterances according to different selectable criteria that correspond to that particular module 1310, 1312, 1314, and 1316. For example, pulse width module 1310 compares a SPW value with a pre-determined (selected) duration. The functionality of modules 1310, 1312, 1314, and 1316 in conjunction with their corresponding selectable criteria, otherwise referred to as predetermined values, is further discussed below. In alternate embodiments, endpoint detection 414 may readily utilize various means other than those discussed in conjunction with the FIG. 13 embodiment to apply validity constraints to a given utterance, in accordance with the present invention.

In accordance with the FIG. 13 embodiment of the present invention, pulse width module 1310 may advantageously utilize several constraint variables during the process of identifying a valid reliable island for a particular utterance. Pulse width module 1310 preferably measures individual pulse widths in speech energy, and may then store each pulse width in constraint value registers 311 as a single pulse width (SPW) value. Pulse width module 1310 may then reference the SPW values to eliminate any energy pulses that are less than a pre-determined duration (for example, 3 frames in the FIG. 13 embodiment).

Pulse width module 1310 may also measure gap durations between individual pulses in speech energy (corresponding to the foregoing SPW values), and may then store each gap duration in constraint value registers 311 as a pulse gap (PG) value. Pulse width module 1310 may then reference the PG values to control the maximum allowed gap duration between energy pulses to be included in a TPW value constraint that is discussed next.

In the FIG. 13 embodiment, validity manager 430 may advantageously utilize pulse width module 1310 to detect a valid reliable island during conditions where speech energy includes multiple speech energy pulses within a certain pre-determined time period "P". In the embodiment discussed in conjunction with the foregoing FIG. 10 flowchart, during step 1016, a beginning point for a reliable island is detected when sequential values for the detection parameter DTF are greater than a reliable island threshold $T_{sr}$ for a given number of consecutive frames (for 5 frames in the FIG. 10 embodiment). However, for multi-syllable words, a single syllable may not last long enough to satisfy the condition of P consecutive frames.

Pulse width module 1310 may preferably sum each energy pulse identified with a SPW value (subject to the foregoing PG value constraint) to thereby produce a total pulse width (TPW) value, that may also be stored in constraint value registers 311. Therefore, during step 1016 of the FIG. 10 method, validity manager 430 may detect a beginning point for a reliable island when a TPW value is greater than a reliable island threshold $T_{sr}$ for a given number of consecutive frames P.

In certain embodiments, pulse width module 1310 may thus utilize the TPW value as a counter to store the total number of frames of speech energy that satisfy a condition that the detection parameter DTF for each consecutive frame is greater than the reliable island threshold $T_{sr}$. Therefore, the pre-determined time period "P" may be counted as the number of energy samples that are greater than the reliable island threshold $T_{sr}$ for a limited time period. In the FIG. 13 embodiment, the foregoing constraint process performed by pulse width module 1310 may preferably occur during step 1016 of the FIG. 10 flowchart.

In the FIG. 13 embodiment, validity manager 430 preferably utilizes minimum power module 1312 t o ensure that speech energy below a pre-determined level is not classified as a valid utterance, even when pulse width module 1310 identifies a valid reliable island. Therefore, in the FIG. 13 embodiment, minimum power module 1312 preferably compares the magnitude peak of segments of the speech energy to a pre-determined constant value.

In the FIG. 13 embodiment, the foregoing constraint process performed by minimum power module 1312 m ay preferably occur immediately after step 1032 of the FIG. 10 flowchart.

In the FIG. 13 embodiment, validity manager 430 preferably utilizes duration module 1314 to impose duration constraints on a given detected segment of speech energy. Therefore, in the FIG. 13 embodiment, duration module 1314 preferably compares the duration of a detected segment of speech energy to two pre-determined constant duration values. In one embodiment, duration module 1314 preferably applies two conditions to a given segment of speech energy according to the following formula:

$$\text{MINUTTDURATION} \leqq \text{Duration} \leqq \text{MAXUTTDURATION}$$

where MINUTTDURATION is a pre-determined constant value for limiting the minimum acceptable duration of a given utterance, MAXUTDURATION is a pre-determined constant value for limiting the maximum acceptable duration of a given utterance, and Duration is the length of the particular detected segment of speech energy that is being analyzed by endpoint detector 414.

In accordance with the present invention, segments of speech with durations that are greater than MAXUTTDURATION are preferably classified as noise. However, segments of speech with durations that are less than MINUTTDURATION are preferably analyzed further by short-utterance minimum power module 1316. In the FIG. 13 embodiment, the foregoing constraint process performed by duration module 1314 may preferably occur immediately after step 1032 of the FIG. 10 flowchart.

In the FIG. 13 embodiment, validity manager 430 preferably utilizes short-utterance minimum power module 1316 to distinguish an utterance of short duration from background pulse noise. To distinguish a short utterance from background noise, the short utterance should have a relatively high energy value. Therefore, in the FIG. 13 embodiment, short-utterance minimum power module 1316 preferably compares the magnitude peak of segments of speech energy to a pre-determined constant value. In one embodiment, short-utterance minimum power module 1316 preferably classifies a short utterance as noise when a condition is satisfied that may be expressed by the following formula:

$$E_{le} - N_{bg} \geqq \text{SHORTMINPEAKSNR}\ (N_{bg})$$

where $E_{le}$ is a magnitude peak of a segment of speech energy that may, for example, be calculated as discussed above in conjunction with FIG. 9(*b*), or that may be the maximum value of CEle over the duration of an utterance. In the foregoing formula, $N_{bg}$ may be the detection parameter background noise value, and SHORTMINPEAKSNR is the pre-determined constant value. In accordance with the present invention, SHORTMINPEAKSNR is preferably selected as a constant that is relatively larger than the pre-determined constant utilized as MINPEAKSNR by minimum power module 1312. In the FIG. 13 embodiment, the foregoing constraint process performed by short-utterance minimum power module 1316 may preferably occur immediately after step 1032 of the FIG. 10 flowchart.

The invention has been explained above with reference to a preferred embodiment. Other embodiments will be apparent to those skilled in the art in light of this disclosure. For example, the present invention may readily be implemented using configurations and techniques other than those described in the preferred embodiment above. Additionally, the present invention may effectively be used in conjunction with systems other than the one described above as the preferred embodiment. Therefore, these and other variations upon the preferred embodiments are intended to be covered by the present invention, which is limited only by the appended claims.

What is claimed is:

1. A system for detecting endpoints of an utterance, comprising:

a processor configured to manipulate speech energy corresponding to said utterance;

a filter bank which band-passes said speech energy before providing said speech energy to, an endpoint detector that is responsive to said processor, said endpoint detector analyzing said speech energy in real time by progressively examining frames of said speech energy in sequence to determine threshold values and energy parameters, said energy parameters being short-term energy parameters corresponding to said frames of said speech energy, said short-term energy parameters being calculated using a following equation:

$$DTF(i) = \sum_{m=0}^{M-1} y_i(m) w_i(m)$$

where $w_i(m)$ is a respective weighting value, $y_i(m)$ is channel signal energy of a channel m at a frame i, and M is a total number of channels of said filter bank, said endpoint detector smoothing said short-term energy parameters by using a multiple-point median filter, said endpoint detector using a starting threshold and said short-term energy parameters to determine a starting point for a reliable island, said speech energy including at least one reliable island in which said short-term energy parameters are greater than said starting threshold and an ending threshold, said endpoint detector calculating a background noise value, said background noise value being derived from said short-term energy parameters during a background noise period, said background noise period ending at least 250 milliseconds ahead of said reliable island and having a normalized deviation that is less than a predetermined value, said endpoint detector comparing said threshold values with said energy parameters to identify a beginning point and an ending point of said utterance; and a validity manager, responsive to said processor, for analyzing said speech energy according to selectable criteria to thereby verify said utterance.

2. The system of claim 1 wherein said endpoint detector uses a stopping threshold and said short-term energy parameters to determine a stopping point for said reliable island.

3. The system of claim 2 wherein said endpoint detector calculates an ending threshold used to refine said ending point by comparing said short-term parameters to said ending threshold or said stopping threshold.

4. The system of claim 1 wherein said endpoint detector calculates signal-to-noise ratios corresponding to said speech energy, and wherein said endpoint detector calculates said threshold values using said signal-to-noise ratios, said background noise value, and pre-determined constant values.

5. The system of claim 1 wherein said endpoint detector calculates a beginning threshold used to refine said beginning point by comparing said short-term parameters to said beginning threshold.

6. A method for detecting endpoints of a spoken utterance, comprising:

analyzing speech energy corresponding to said spoken utterance;

calculating energy parameters in real time, said energy parameters corresponding to frames of said speech energy;

determining a starting threshold corresponding to a reliable island in said speech energy;

locating a starting point of said reliable island by comparing said energy parameters to said starting threshold;

performing a refinement procedure to identify a beginning point for said spoken utterance by calculating a beginning threshold corresponding to said spoken utterance, and comparing said energy parameters to said be ginning threshold to locate said beginning point of said spoken utterance, said beginning threshold $T_{sr}$ being calculated according to a following equation:

$$T_{sr}=N_{bg}(1+SNR_{ls})+f(N_w)+c_1V_{bg}$$

where $N_{bg}$ is said background noise value, $SNR_{ls}$ is a starting signal-to-noise ratio, $c_{sr}$ is a starting constant, $c_1$ is a constant value, $N_w$ is a parameter related to gain that is imposed on said energy parameters due to a weight vector w, f represents a mathematical weighting function that applies said $N_w$ to said energy parameters, and $V_{bg}$ is a sample standard deviation of said background noise;

determining a stopping threshold corresponding to said reliable island in said speech energy;

determining an ending threshold corresponding to said spoken utterance;

comparing said energy parameters to said stopping threshold and to said ending threshold;

performing a refinement procedure to identify an ending point for said spoken utterance; and analyzing said speech energy using a validity manager to thereby verify said utterance according to selectable criteria.

7. The method of claim 6 wherein said ending threshold is a threshold $T_{er}$ that is calculated according to a following equation:

$$T_{er}=N_{bg}(1+SNR_{le}/c_{er})+f(N_w)+c_1V_{bg}$$

where $N_{bg}$ is said background noise value, $SNR_{le}$ is an ending signal-to-noise ratio, $c_{er}$ is an ending constant, $c_1$ is said constant value, $N_w$ is a parameter related to gain that is imposed on said energy parameters due to a weight vector w, f represents said mathematical weighting function that applies said $N_w$ to said energy parameters, and $V_{bg}$ is a sample standard deviation of said background noise.

8. The system of claim 7 wherein said $N_w$ is defined by a following equation:

$$N_w=\sum_{m=0}^{P} w(m)sw(m)$$

where w(m) is a weighting value and sw(m) is a speech energy distribution value.

* * * * *